US006101943A

United States Patent [19]

Hara et al.

[11] Patent Number: 6,101,943

[45] **Date of Patent: *Aug. 15, 2000**

[54] CYLINDER CLEANING DEVICE AND CLEANING METHOD

[75] Inventors: Akira Hara, Tokyo; Hiraku Onuma, Yokohama; Hideo Oyaizu, Tokyo; Ryozo Suzuki, Omiya, all of Japan

[73] Assignee: Baldwin-Japan, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/023,814

[22] Filed: Feb. 13, 1998

[30] Foreign Application Priority Data

Feb. 19, 1997 [JP] Japan ..... 9-051084

[51] Int. Cl.[7] ..... B41F 35/02

[52] U.S. Cl. ..... 101/425; 101/423

[58] Field of Search ..... 101/423, 424, 101/425; 15/256.51, 256.52

[56] References Cited

U.S. PATENT DOCUMENTS

| | | | |
|---|---|---|---|
| 2,525,982 | 10/1950 | Wescott | 101/425 |
| 3,952,654 | 4/1976 | Evans | 101/425 |
| 4,007,983 | 2/1977 | Knieser | 15/256.51 |
| 4,390,268 | 6/1983 | Furuichi et al. | 15/256.51 |
| 4,870,900 | 10/1989 | Robertson | 101/425 |
| 4,920,880 | 5/1990 | Hara et al. | 101/423 |
| 5,153,964 | 10/1992 | Gelardi et al. | 15/256.51 |
| 5,271,326 | 12/1993 | Ebina | 101/423 |
| 5,367,955 | 11/1994 | Hara et al. | 101/425 |
| 5,368,157 | 11/1994 | Gasparrini et al. | 206/209 |
| 5,797,063 | 8/1998 | Umezawa et al. | 399/34 |

FOREIGN PATENT DOCUMENTS

| | | |
|---|---|---|
| 0364901 | 4/1990 | European Pat. Off. . |
| 0466203 | 1/1992 | European Pat. Off. . |
| 0548500 | 6/1993 | European Pat. Off. . |
| 0562281 | 9/1993 | European Pat. Off. . |
| 8816264 | 3/1989 | Germany . |
| 3744800 | 6/1989 | Germany . |
| 19516422 | 11/1996 | Germany . |
| 9406633 | 3/1994 | WIPO . |

OTHER PUBLICATIONS

Thayer, "Photorceptor Toner Cleaning Member", Xerox Disclosure Journal., vol. 4, No. 5, Sep. 10, 1979.

*Primary Examiner*—John S. Hilten
*Assistant Examiner*—Anthony H. Nguyen
*Attorney, Agent, or Firm*—Morgan & Finnegan

[57] ABSTRACT

There is disclosed a device for cleaning the cylinder of a printing press with a cleaning fabric. The device comprises a pad including a surface opposed to the cylinder. The cleaning fabric is directed between the surface of the pad and the cylinder, the surface of the pad being at least partially uneven. The device further comprises means for moving the surface of the pad toward the cylinder so that the cleaning fabric is pressed against the cylinder by the pad to clean the cylinder.

4 Claims, 5 Drawing Sheets

CYLINDER CLEANING DEVICE AND CLEANING METHOD

BACKGROUND OF THE INVENTION

1. Field of the Invention

The invention relates to a device for cleaning the cylinder of a printing press with a cleaning fabric.

2. Description of Related Art

There has been commercially available a device for cleaning the cylinder of a printing press with a cleaning fabric. For example, in a sheet-fed press, the device is used to clean the cylinder such as an impression cylinder or blanket cylinder. In a web-fed press, the device is also used to clean the cylinder such as a blanket cylinder. The device comprises a pad including a surface opposed to the cylinder. The cleaning fabric is directed between the surface of the pad and the cylinder. A cleaning agent or detergent may be impregnated into the cleaning fabric at a position upstream of the pad in the printing press. The cleaning fabric may have a cleaning agent or detergent previously impregnated thereinto, as disclosed in U.S. Pat. No. 5,368,157. The device further comprises means such as levers actuated by a cam, or a cylinder for moving the surface of the pad toward the cylinder so that the cleaning fabric is pressed against the cylinder by the pad to clean the cylinder.

In the device, it is required that the cleaning fabric is strongly pressed against the cylinder by the pad for providing a wiping action with respect to the outer surface of the cylinder. However, the cleaning agent or detergent is squeezed out of the cleaning fabric when the cleaning fabric is strongly pressed against the cylinder. The cleaning agent or detergent can therefore not be held on the outer surface of the cylinder. Accordingly, the device can not always effectively clean the outer surface of the cylinder due to lack of the cleaning agent or detergent held on the cylinder.

In addition, in the sheet-fed press, the impression cylinder includes grippers mounted thereon and spaced from each other in the axial direction of the cylinder for catching a sheet printed or to be printed. The grippers are rotated integrally with the cylinder in the cleaning operation. In the case, it is required that the cleaning fabric and the pad are moved and retracted from the cylinder before the grippers reach the position of the cleaning fabric and the pad, otherwise the grippers may be damaged by the cleaning fabric and the pad pressed against the grippers. The cleaning fabric is then pressed against the cylinder by the pad after the grippers have passed through the position of the cleaning fabric and the pad. Accordingly, the cleaning fabric is usually pressed against the cylinder at a distance of 4 mm from the ends of the grippers.

However, this step can not clean the portion of the cylinder adjacent and between the grippers. This step can not also clean the grippers itself. It is therefore required to timely and manually clean the portion of the cylinder adjacent and between the grippers, and timely and manually clean the grippers itself. In general, 22 grippers are mounted on the impression cylinder having a diameter of 40 inches. It is laborious and troublesome to considerably clean the portion of the cylinder adjacent and between the grippers, and considerably clean the grippers itself.

It is therefore an object of the invention to provide a new and improved device for cleaning the cylinder of a printing press with a cleaning fabric, to thereby overcome the above problems.

Another object of the invention is to provide the device in which the cleaning agent or detergent can be held on the outer surface of the cylinder even if the cleaning fabric is strongly pressed against the cylinder by the pad.

Other object of the invention is to provide the device which can effectively clean the outer surface of the cylinder.

Other object of the invention is to provide the device which can clean not only the outer surface of the cylinder but also the portion of the cylinder adjacent and between the grippers as well as at least a part of the grippers in a sheet-fed press.

SUMMARY OF THE INVENTION

According to the invention, there is provided a device for cleaning the cylinder of a printing press with a cleaning fabric. The device comprises a pad including a surface opposed to the cylinder. The cleaning fabric is directed between the surface of the pad and the cylinder, the surface of the pad being at least partially uneven. The device further comprises means for moving the surface of the pad toward the cylinder so that the cleaning fabric is pressed against the cylinder by the pad to clean the cylinder.

In a preferred embodiment, the surface of the pad is formed partially unevenly along one edge of the surface for providing a buffer action.

The pad may be made of an elastomer for providing a buffer action.

The pad may comprise different members one of which has an uneven surface.

The surface of the pad may be concave.

The surface of the pad may be divided into small pieces to be uneven.

The surface of the pad may include projections and recessions formed substantially throughout the surface and arranged alternately with each other to be uneven.

The surface of the pad may include projections and recessions formed along one edge of the surface to be uneven.

The projections and recessions may have at least one of serrated, angle-shaped, wave-shaped and rectangular wave-shaped sections.

The pad may include a portion comprising a brush-shaped or comb teeth-shaped structure to have an uneven surface.

The pad may be supported by a support for movement to adjust the position of the pad in the rotating direction of the cylinder.

The pad may be made of an elastomer which includes portions having thicknesses different from each other and juxtaposed in the rotating direction of the cylinder.

The pad may be held by a holder which includes portions having thicknesses different from each other and juxtaposed in the rotating direction of the cylinder.

The printing press may comprise a sheet-fed press. The cylinder may comprise an impression cylinder which includes gripper means mounted thereon for catching a sheet printed or to be printed.

The pad may be hollow.

The pad may be cylindrical.

The printing press may comprise a sheet-fed press or web-fed press, the cylinder including no gripper means for catching a sheet printed or to be printed.

There is also provided a method of cleaning the cylinder of a printing press with a cleaning fabric. The printing press comprises a sheet-fed press. The cylinder comprises an impression cylinder which includes a gripper means for catching a sheet printed or to be printed. The method comprises using a pad including a surface which is opposed to the cylinder. The cleaning fabric is directed between the surface of the pad and the cylinder. The pad provides a buffer action. The method further comprises moving the pad toward the cylinder so that the cleaning fabric is firstly pressed against the gripper means by the pad to clean at least a part of the gripper means and then pressed against the cylinder by the pad to clean the cylinder.

DETAILED DESCRIPTION OF THE PREFERRED EMBODIMENTS

Figure 1:
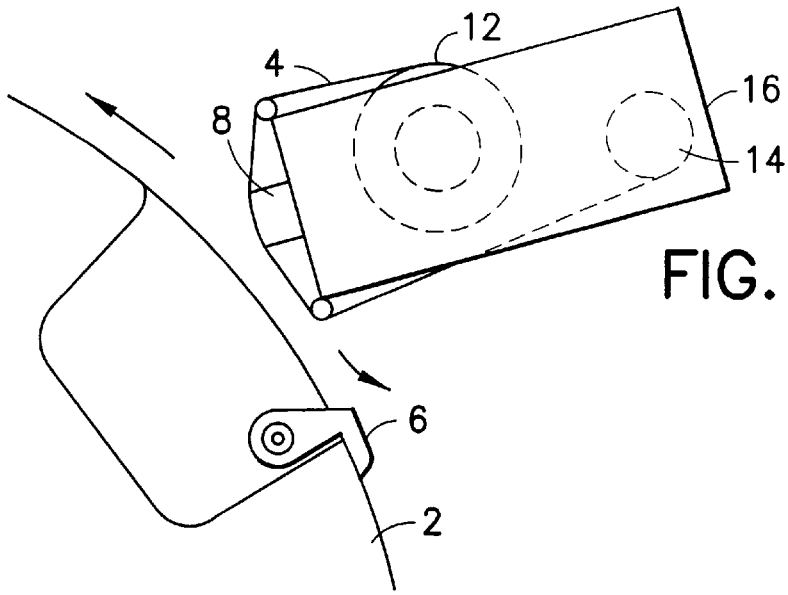
FIG. 1 is a schematic view of a device for cleaning the cylinder of a sheet-fed press with a cleaning fabric according to the invention.

Turning now to the drawings, FIG. 1 illustrates a device for cleaning the cylinder 2 of a printing press with a cleaning fabric 4, according to the invention. The printing press comprises a sheet-fed press. The cylinder 2 comprises an impression cylinder which includes grippers 6 mounted thereon and spaced from each other in the axial direction of the cylinder 2 for catching a sheet printed or to be printed.

Figure 4:
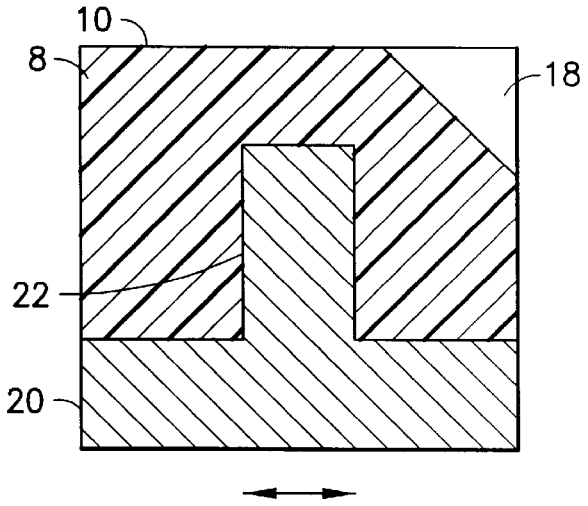
FIG. 4 is a cross sectional view of the pad of FIG. 1.

The device comprises a pad 8 including a surface 10 as shown in FIG. 4. The surface 10 is opposed to the cylinder 2. The cleaning fabric 4 is directed between the surface 10 of the pad 8 and the cylinder 2 from a supply roll 12. The cleaning fabric 4 is further directed to a take-up roll 14 which can be rotated by drive means not shown to take up the cleaning fabric 4 so that the cleaning fabric 4 is intermittently or continuously fed to the pad 8 from the supply roll 12. A cleaning agent or detergent is impregnated into the cleaning fabric, 4 at a position upstream of the pad 8 in the printing press. The cleaning fabric 4 may have a cleaning agent or detergent previously impregnated thereinto. The pad 8, the supply roll 12 and the take-up roll 14 are mounted on side plates 16 which are connected to each other by cross member means not shown.

Figure 5:
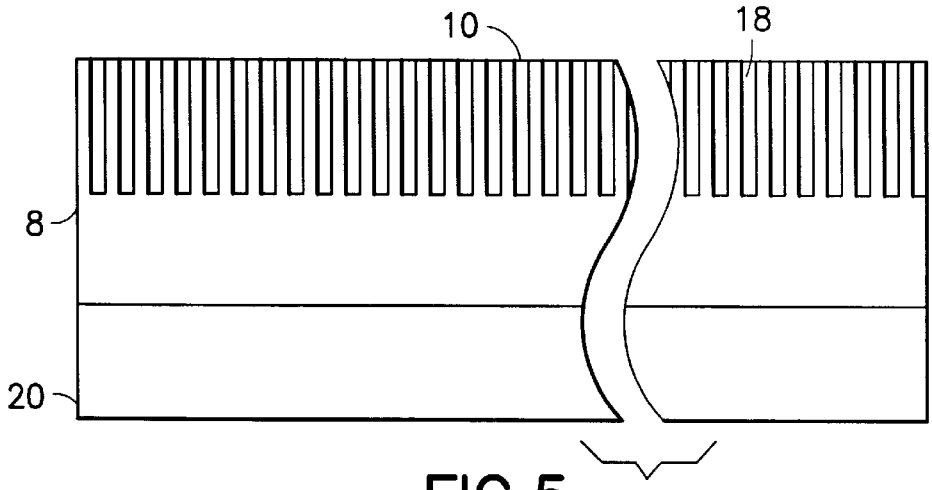
FIG. 5 is an elevational view of the pad of FIG. 4.

The surface 10 of the pad 8 is at least partially uneven. In the embodiment, the pad 8 includes a plurality of slots 18 formed obliquely with respect to the surface 10 along one edge thereof, as shown in FIG. 5. Accordingly, the surface 10 of the pad 8 is formed partially unevenly along one edge of the surface 10 by the slots 18.

The device further comprises means such as levers actuated by a cam, or a cylinder for moving the surface 10 of the pad 8 toward the cylinder 2 so that the cleaning fabric 4 is pressed against the cylinder 2 by the pad 8 to clean the cylinder 2. For example, the side plates 16 are mounted on a frame not shown for swingingly movement. The side plates 16 are connected to levers or cylinder for moving the side plates 16 swingingly and downward to move the surface 10 of the pad 8 toward the cylinder 2. The device may be arranged to linearly move the side plates 16 and the pad 8 toward the cylinder 2. Air under pressure may also be used to move the surface 10 of the pad 8 toward the cylinder. The cylinder 2 is rotated counterclockwise in FIG. 1 when the cleaning fabric 4 is pressed against the cylinder 2 by the pad 8, to clean the cylinder 2 throughout the outer surface thereof. The grippers 6 are rotated integrally with the cylinder 2 in the cleaning operation.

In the device, the cleaning agent or detergent is squeezed out of the cleaning fabric 4 when the cleaning fabric 4 is strongly pressed against the cylinder 2 for providing a wiping action with respect to the outer surface of the cylinder 2. As to the cleaning agent or detergent squeezed out of the cleaning fabric 4, it is held in the slots 18 in the surface 10 of the pad 8 on the outer surface of the cylinder 2. The cleaning agent or detergent can therefore cooperate with the cleaning fabric 4 to effectively clean the outer surface of the cylinder 2.

Figure 2:
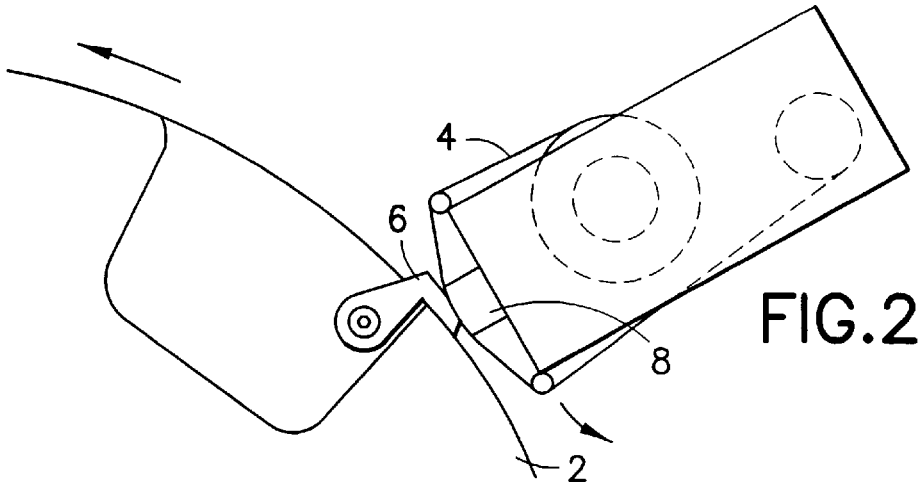
FIG. 2 is a schematic view showing the cleaning fabric pressed against the grippers by the pad of FIG. 1.
Figure 3:
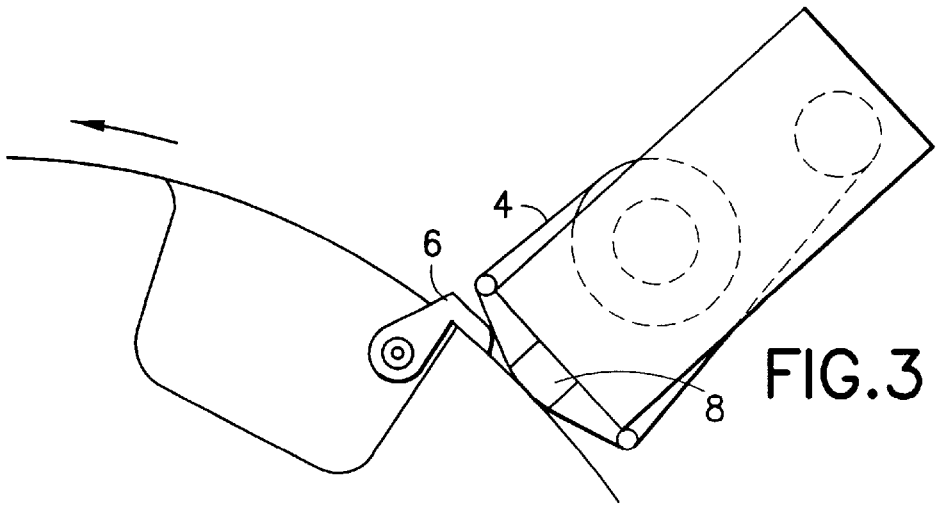
FIG. 3 is a schematic view showing the cleaning fabric pressed against the cylinder by the pad of FIG. 2.

In addition, the device is arranged that the cleaning fabric 4 and the pad 8 are moved and retracted from the cylinder 2 before the grippers 6 reach the position of the cleaning fabric 4 and the pad 8. Furthermore, the cleaning fabric 4 is firstly pressed against the grippers 6 by the pad 8 including the slots 18 when the grippers 6 reach the position of the cleaning fabric 4 and the pad 8, as shown in FIG. 2. The slots 18 are positioned along the upper edge of the surface 10 of the pad 8 for providing a buffer action to absorb the shock between the cleaning fabric 4 and the grippers 6 so that the grippers 6 are not damaged by the cleaning fabric 4 and the pad 8. The device can therefore clean the portion of the cylinder 2 adjacent and between the grippers 6. It can also clean at least a part of the grippers 6. The cleaning fabric 4 is then pressed against the cylinder 2 by the pad 8 to clean the cylinder 2, as shown in FIG. 3.

The pad 8 is held on a holder 20 which is supported by a support not shown for movement to adjust the position of the pad 8 in the rotating direction of the cylinder 2 so that the cleaning fabric 4 can be conveniently pressed against the grippers 6. The support is mounted on the side plates 16.

The pad 8 may be made of an elastomer for providing a buffer action to absorb the shock between the cleaning fabric 4 and the grippers 6. In this connection, the pad 8 may include portions having thicknesses different from each other and juxtaposed in the rotating direction of the cylinder 2. The holder 20 may include portions having thicknesses different from each other and juxtaposed in the rotating direction of the cylinder 2. In the embodiment, the pad 8 includes three portions juxtaposed in the rotating direction of the cylinder 2. A cavity formed in the central portion of the pad 8 so that the central portion is thinner than the opposite side portions of the pad 8. The holder 20 includes three portions juxtaposed in the rotating direction of the cylinder 2 and has a ridge 22 formed on the central portion of the holder 20 so that the central portion is thicker than the opposite side portions of the holder 20. The ridge 22 is fitted into the cavity in the pad 8 which is held on the holder 20. This arrangement can conveniently absorb the shock between the cleaning fabric 4 and the grippers 6. In addition, the cleaning fabric 4 can be strongly pressed against the outer surface of the cylinder 2 by the pad 8 and the holder 20 to clean the cylinder 2.

Figure 6:
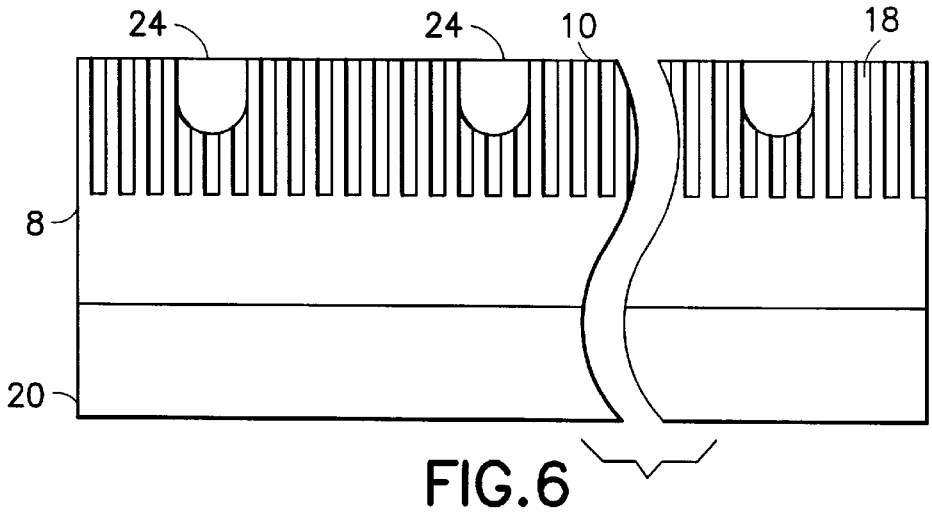
FIG. 6 is an elevational view of another embodiment.

The surface 10 of the pad 8 may includes notches 24 formed and spaced along the edge thereof at positions corresponding to the grippers 6 of the cylinder 2 to clear the grippers 6 without interference, as shown in FIG. 6. The notches 24 may be formed in positions when the device is installed on the printing press.

Figure 7:
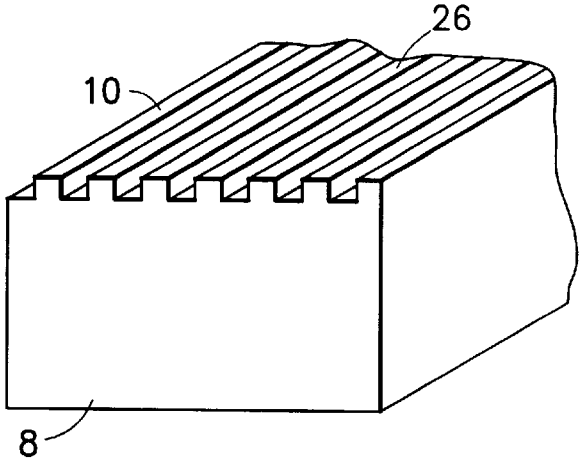
FIG. 7 and FIG. 8 are perspective views of other embodiments.

In other embodiment shown in FIG. 7, the surface 10 of the pad 8 includes projections 26 and recessions formed substantially throughout the surface 10 and arranged alternately with each other to be uneven. The projections 26 and recessions have rectangular wave-shaped sections and extend parallel to the axial direction of the cylinder 2 so that the cleaning agent or detergent can be conveniently held in the recessions in the surface 10 of the pad 8 on the outer surface of the cylinder 2.

Figure 8:
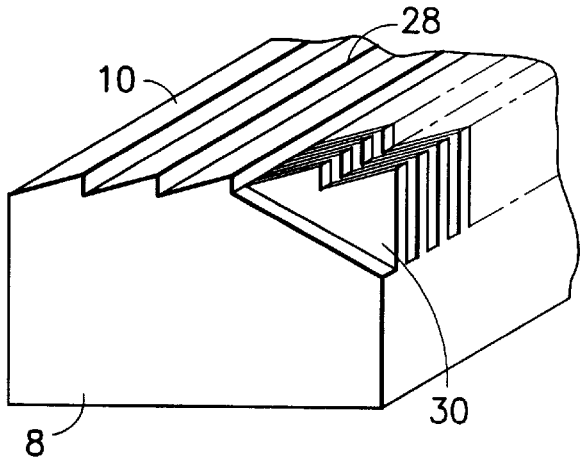

In other embodiment shown in FIG. 8, the surface 10 of the pad 8 includes projections 28 and recessions formed throughout the surface 10 and arranged alternately with each other to be uneven. The projections 28 and recessions have serrated sections. In addition, the surface 10 of the pad 8 includes projections 30 and recessions formed along one edge of the surface 10, the recessions being formed obliquely with respect to the surface 10, like the slots 18 in FIG. 4.

Figure 9:
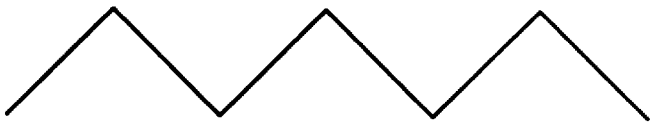
FIG. 9 and FIG. 10 are schematic views of other embodiments.
Figure 10:
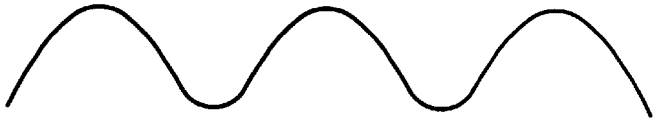

The projections and recessions may have angle-shaped sections, as shown in FIG. 9. The projections and recessions may have wave-shaped sections, as shown in FIG. 10.

Figure 11:
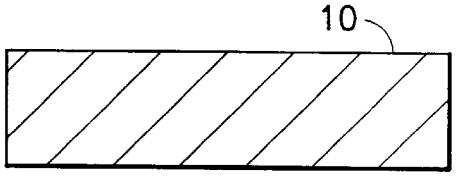
FIG. 11 to FIG. 16 are plan views of other embodiments.
Figure 12:
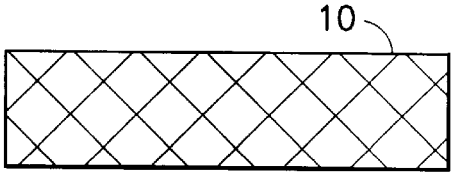
Figure 13:
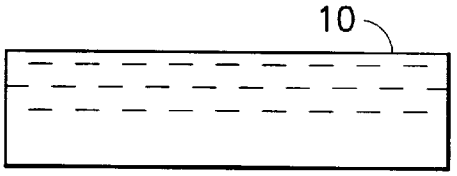
Figure 14:
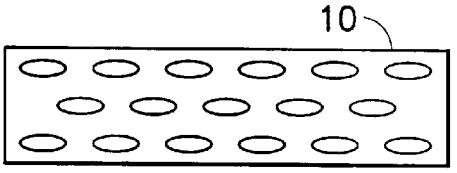
Figure 15:
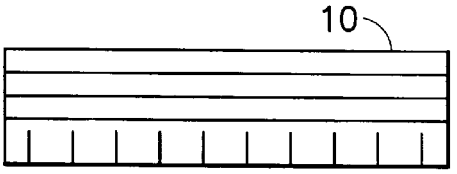

The surface 10 of the pad 8 may include projections and recessions extending not parallel to the axial direction of the cylinder 2, as shown in FIG. 11. Projections and recessions may be formed in accordance with a mesh pattern, as shown in FIG. 12. The surface 10 of the pad 8 may include projections or recessions of discontinuity extending parallel to the axial direction of the cylinder 2, as shown in FIG. 13. Projections or recessions may be scattered throughout the surface 10, as shown in FIG. 14. The surface 10 of the pad 8 may include projections and recessions extending parallel to the axial direction of the cylinder 2 and perpendicularly thereto, as shown in FIG. 15.

Figure 16:
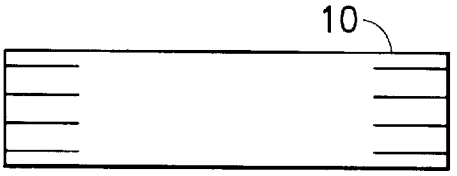

By the way, in an offset printing press, the impression cylinder and the blanket cylinder are liable to be dirtied with ink, in particular at the opposite end portions thereof. In view of the opposite end portions dirtied with ink, projections or recessions may be formed in the opposite end portions of the pad 8, as shown in FIG. 16. In the embodiment, the cleaning agent or detergent is held on the outer surface of the cylinder 2, in particular at the opposite end portions thereof, to effectively clean the outer surface of the cylinder.

Figure 17:
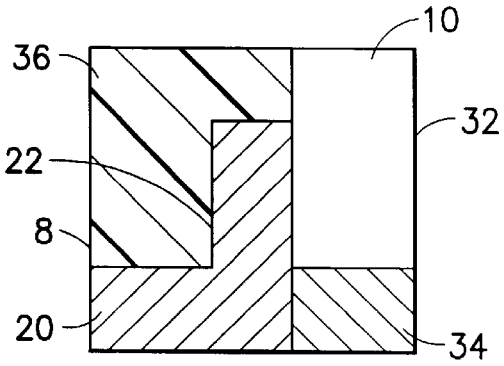
FIG. 17 and FIG. 18 are cross sectional views of other embodiments.

In other embodiment shown in FIG. 17, the pad 8 includes a portion composed of a member 32 which comprises a brush-shaped or comb teeth-shaped structure embedded in a holder 34 to have an uneven surface 10. The member 32 is juxtaposed with a member 36 held on the holder 20 which has a ridge 22 formed thereon, like the embodiment in FIG. 4. The holder 34 is connected to the holder 20. Accordingly, the pad 8 comprises different members 32 and 36 one of which 32 has an uneven surface 10. The member 32 provides a buffer action to absorb the shock between the cleaning fabric 4 and the grippers 6. The ridge 22 and the member 36 keep the member 32 from being buckling.

Figure 18:
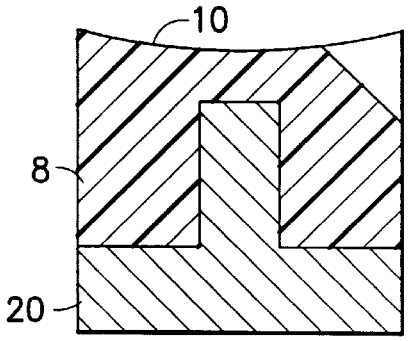

In other embodiment shown in FIG. 18, the surface 10 of the pad 8 is concave with a curvature corresponding to the outer surface of the cylinder 2. In the embodiment, the cleaning fabric 4 and the pad 8 can be fitted to the outer surface of the cylinder 2 to effectively clean the cylinder 2.

The surface 10 of the pad 8 may be divided into small pieces to be uneven.

The device may be used to clean a cylinder such as a blanket cylinder which including no gripper means for catching a sheet printed or to be printed, in the sheet-fed press or web-fed press.

Figure 19:
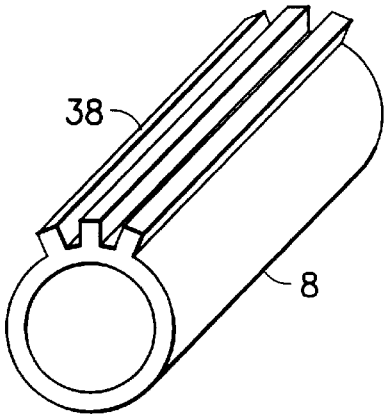
FIG. 19 and FIG. 20 are perspective views of other embodiments.
Figure 20:
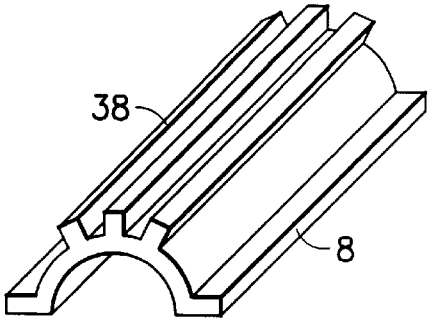

The pad 8 may be hollow. The pad 8 may be cylindrical. In other embodiment shown in FIG. 19, the pad 8 is hollow and cylindrical. In other embodiment shown in FIG. 20, the pad 8 is hollow and dome-shaped. The pad 8 includes projections 38 extending longitudinally thereof and substantially throughout the length of the pad 8, and spaced from each other circumferentially of the pad 8 so that recessions are formed between the projections 38. The projections 38 and recessions may have at least one of serrated, angle-shaped, wave-shaped and rectangular wave-shaped.

What is claimed is:

1. A device for cleaning an impression cylinder of a sheet-fed printing press with a cleaning fabric, the impression cylinder having gripper means to catch a sheet printed or to be printed and including a portion adjacent the gripper means, the impression cylinder rotating in a direction, the device comprising:

a pad having a length to extend parallel to the cylinder and including a surface to receive the cleaning fabric, the pad comprising first and second members extending longitudinally thereof and juxtaposed with each other in the rotating direction of the cylinder, the first member being different in hardness from the second member and positioned downstream of the second member in the rotating direction of the cylinder; and means for moving the surface of the pad to first press the fabric against the gripper means and the portion of the cylinder adjacent the gripper means and then against another portion of the cylinder, the first member being relatively soft for providing a buffer action to absorb shock between the cleaning fabric and the gripper means, the second member being relatively hard for strongly pressing the fabric against the gripper means and the portion of the cylinder adjacent the gripper means to clean at least a part of the gripper means and the portion of the cylinder adjacent the gripper means.

2. The device of claim 1 wherein the first member comprises a brush-shaped or comb teeth-shaped structure to be relatively soft.

3. The device of claim 1 wherein the pad is supported by a support for movement to adjust the position of the pad in the rotating direction of the cylinder.

4. A method of cleaning an impression cylinder of a sheet-fed press with a cleaning fabric, the impression cylinder having gripper means to catch a sheet printed or to be printed and including a portion adjacent the gripper means, the impression cylinder rotating in a direction, the method comprising:

first, interposing the fabric between the cylinder and a pad;

second, pressing the fabric against the gripper means and the portion of the cylinder adjacent the gripper means with the pad to clean at least a part of the gripper means and the portion of the cylinder adjacent the gripper means, the pad providing a buffer action to absorb shock between the fabric and the gripper means, and third, after pressing the fabric against the gripper means and the portion of the cylinder adjacent the gripper means, pressing the fabric against another portion of the cylinder with the pad to clean the cylinder.

* * * * *